United States Patent [19]

Santo

[11] 4,279,061

[45] Jul. 21, 1981

[54] FLEXIBLE SHEET SECURING APPARATUS

[76] Inventor: Philip J. Santo, 3750 Monroe Ave., Pittsford, N.Y. 14534

[21] Appl. No.: 99,654

[22] Filed: Dec. 3, 1979

[51] Int. Cl.[3] ..... A47C 21/02

[52] U.S. Cl. ..... 24/72.5; 5/451; 24/255 R; 160/391

[58] Field of Search ..... 5/451, 452, 488, 495, 5/496, 498, 499, 471, 403, 402, 404, 406, 407; 24/72.5, 255 R, 259 FS, 67.9, 67.11; 160/391

[56] References Cited

U.S. PATENT DOCUMENTS

| | | | |
|---|---|---|---|
| 3,379,237 | 4/1968 | Worthington | 160/391 |
| 3,851,848 | 12/1974 | Wiele | 160/391 |
| 4,089,075 | 5/1978 | May | 5/404 |

*Primary Examiner*—Alexander Grosz

*Attorney, Agent, or Firm*—Lawrence P. Kessler

[57] ABSTRACT

Apparatus for securing a flexible sheet, particularly through an intermediate member, to the frame surrounding the fluid-filled bladder of a waterbed. The apparatus comprises a U-shaped member of resilient material having a web portion and opposed first and second legs of substantially equal length extending from the web portion. The first leg has a lip directed away from the second leg. A retention member is connected to the second leg at the end of the second leg opposite the web portion and extends across the space between the opposed legs for less than such space. The retention member has a lip directed toward the second leg, whereby a flexible sheet inserted between the first leg and the retention member is secured when the lip on the first leg is engaged by the lip of the retention member.

6 Claims, 3 Drawing Figures

FLEXIBLE SHEET SECURING APPARATUS

BACKGROUND OF THE INVENTION

This invention relates generally to securing apparatus, and more particularly to apparatus for securing a flexible sheet to a frame.

In a typical waterbed, a fluid-filled bladder is supported on a pedestal and surrounded by a frame. A sheet of flexible fluid-impervious material is connected to the frame and lies across the pedestal under the bladder. The flexible sheet protects against leakage of fluid from the bladder. In the past, the connection of the sheet to the frame was accomplished by permanent fasteners, such as by stappling the sheet to the frame. This, of course, put holes in the flexible sheet and created points of weakness. Any stretching of the sheet, such as when a decorative cover is placed over the bladder and tucked between the bladder and frame, could cause a tear which would eminate from a hole. Further, as the cover is tucked in, the staples could cause personal injury. Recently some devices have been proposed for securing the flexible sheet to the frame through an intermediate member permanently fixed to the frame. However, the means by which the intermediate member is fixed to the frame may still cause personal injury, and such intermediate members have not proven effective in accomplishing the securing of the sheet to the frame when the sheet is stretched.

SUMMARY OF THE INVENTION

This invention provides an apparatus for securing a flexible sheet, particularly through an intermediate member, to the frame surrounding the fluid-filled bladder of a waterbed. The apparatus comprises a U-shaped member of resilient material having a web portion and opposed first and second legs of substantially equal length extending from the web portion. The first leg has a lip directed away from the second leg. A retention member is connected to the second leg at the end of the second leg opposite the web portion and extends across the space between the opposed legs for less than such space. The retention member has a lip directed toward the second leg, whereby a flexible sheet inserted between the first leg and the retention member is secured when the lip on the first leg is engaged by the lip of the retention member.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
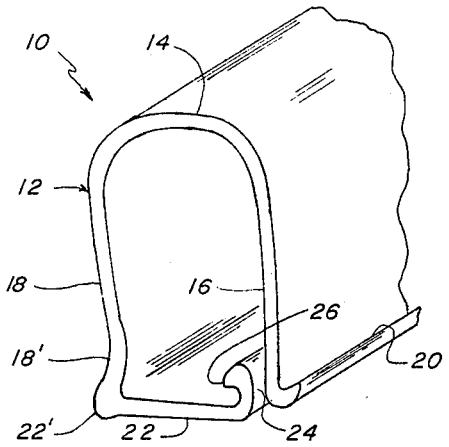
FIG. 1 is a view in perspective on an enlarged scale of a portion of the flexible sheet securing apparatus according to this invention.

Referring now to the accompanying drawings, the flexible sheet securing apparatus, shown in FIG. 1, is generally designated by the numeral 10. The apparatus 10 includes a U-shaped member 12 having a web portion 14. Opposed legs 16 and 18 of substantially equal length extend from the web portion 14. Leg 16 has a lip 20 along one marginal edge directed away from the leg 18. A retention member 22 is connected to the leg 18 along the marginal edge opposite the web portion 14. The retention member 22 extends across the space between the opposed legs, but for less than such space. An upturned edge 24 of the member 22 has a lip 26 directed back toward leg 18. The lip 26 is complimentary to the lip 20.

The U-shaped member 12 and the retention member 22 of the apparatus 10 may be integrally formed, for example by extrusion techniques. The apparatus 10 is made of a material, such as polypropylene, which is rigid in the longitudinal direction and resilient in the direction across the space between the opposed legs. This enables the legs to be flexed from the location of FIG. 1, toward one another, and always be urged to return to the preflexed location. The apparatus 10 is particularly formed such that leg 18 has a slight concave curvature 18' immediately above the interconnection with the retention member 22, and a bead of material 22' running along the line of interconnection is substantially thicker than the leg 18 or the retention member 22. The curvature 18' and bead of material 22' provide a degree of rigidity between the leg 18 and the member 22 which maintains the leg and member at a substantially right angle.

Figure 2:
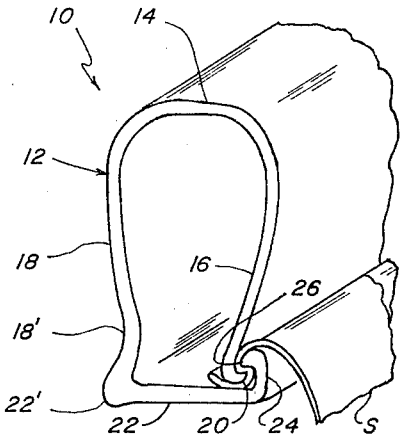
FIG. 2 is a view in perspective of sheet securing apparatus, similar to FIG. 1, but with a sheet secured thereby.

When leg 16 is flexed from its position of FIG. 1 toward leg 18, the lip 20 may be slipped under the complimentary lip 26 (see FIG. 2), and a tight clamp is formed between the lips. The clamping action is maintained because of the rigidity between leg 18 and member 22 and the resilience of the material of the apparatus 10. That is, the material resilience urges the leg 16 away from leg 18 toward its initial (pre-flexed) location with the lip 26 engaging the lip 20 to oppose such urging; and the rigidity between the leg 18 and member 22 keeps the lip 26 in its opposing position. Accordingly, a flexible sheet S, placed over the lip 26 prior to the bending of leg 16, is secured and retained by the apparatus 10 when the lip 20 is slipped under the lip 26 (FIG. 2).

Figure 3:
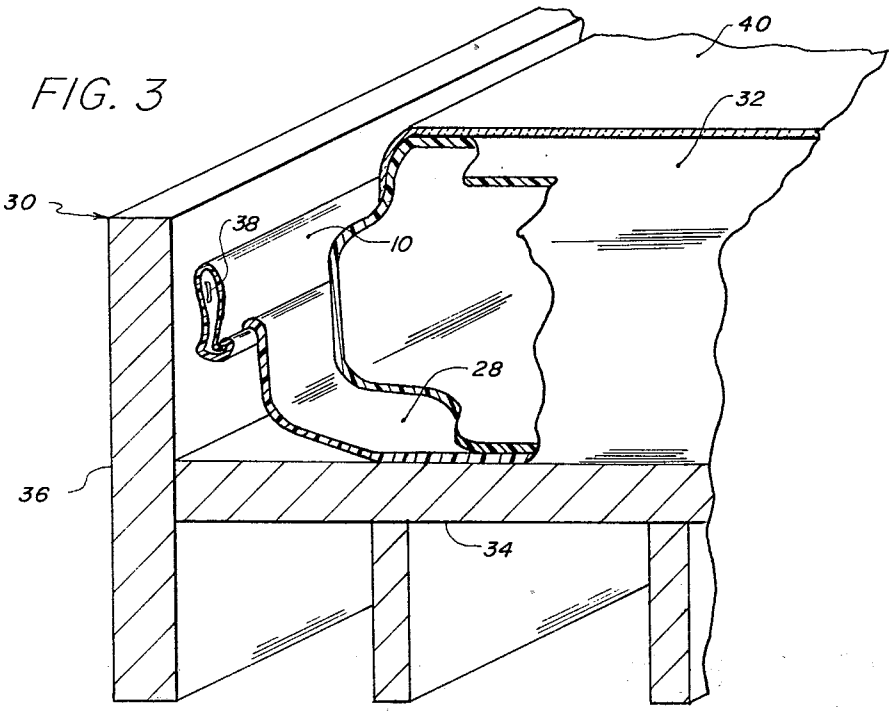
FIG. 3 is a cross-sectional view in perspective of a waterbed incorporating the flexible sheet securing apparatus of FIG. 1 securing a flexible sheet to the frame.

In FIG. 3, the apparatus 10 is shown as being employed to secure a flexible sheet 28 to a waterbed 30. The waterbed 30 includes a fluid-filled bladder 32 supported by a pedestal 34 and a circumferential frame 36. The sheet 28, of fluid-impervious material, protects the frame and pedestal from any leakage of fluid from the bladder. The apparatus 10 is connected to opposing sides of the frame (one side shown) by applying suitable fasteners 38, such as the staples or screws, through leg 18 to the frame. The heads of the fasteners are contained within the cavity between the web portion 14, legs 16 and 18 and the retention member 22. Thus, there is no possibility of personal injury from the fasteners. The sheet is placed over the lip 26 and the lip 20 is slipped under the complimentary lip 26. It has been determined that if the flexible sheet 28 is 8–20 mils thick, an effective clamp is provided when the legs 16 and 18 extend one inch from the web 14. The thickness of the legs is 3/64 of an inch, the radius of the curvature 18' is 3/16 inches and the bead 22' is 3/32 inches thick. Such configuration for the apparatus 10 assures that the sheet 28 will not come loose when the sheet is stretched by tucking a decorative cover 40 between the bladder and frame or upon movement of the bladder.

The invention has been described in detail with particular reference to a preferred embodiment thereof, but it will be understood that variations and modifications can be effected within the spirit and scope of the invention.

I claim:

1. Apparatus for securing a flexible sheet comprising:

a substantially U-shaped member of resilient material having a web portion, and opposed first and second legs of substantially equal length extending from said web portion, said first leg having a lip directed away from said second leg;

a retention member connected to said second leg at the end of said second leg opposite said web portion, extending across the space between said opposed legs for less than such space, said second leg having a concave curvature immediately above the area of connection between said second leg and said retention member, such area being substantially thicker than either said second leg or said retention member, said retention member having a lip directed toward said second leg, whereby a flexible sheet inserted between said first leg and said retention member is secured when said lip on said first leg is engaged by said lip of said retention member.

2. The invention of claim 2 wherein said U-shaped member and said retention member are integrally formed.

3. For use in a waterbed including a flexible fluid-containing bladder and a frame surrounding said fluid-containing bladder and for supporting such bladder, means for securing a fluid-impervious sheet of flexible material to said frame between said frame and said bladder, said securing means comprising.

a first member adapted to be connected to at least a portion of said frame;

a second member coextensive with said first member, said second member having a first marginal edge having a transversely extending lip and a second marginal edge, means for connecting said second member to said first member at said second marginal edge so that said lip of said first marginal edge is directed away from said first member, and so that said first marginal edge is urged away from said first member; and a third member connected to said first member and extending outwardly therefrom, said first member having a concave curvature immediately above the area of connection with said third member, such area being substantially thicker than either said first member or said third member to provide rigidity between said first member and said third member said third member having a portion adjacent to said first marginal edge of said second member, said portion including retaining means for selectively engaging said lip to retain said first marginal edge against being urged away from said first member; whereby when an edge of said fluid-impervious sheet material is located between said lip and said retaining means, and said retaining means is engaged with said lip, said sheet of material is secured to said frame between said frame and said bladder.

4. The invention of claim 3 wherein said connecting means is a web connected to said first member along one marginal edge and to said third member along the opposite marginal edge.

5. The invention of claim 4 wherein said third member, said first member, said web, and said second member are integrally formed of resilient material.

6. The invention of claim 3 wherein said retaining means is a lip complimentary to said lip of said second member.

* * * * *